United States Patent [19]

Schrader et al.

[11] Patent Number: 4,988,017

[45] Date of Patent: Jan. 29, 1991

[54] DUAL CHAMBER AEROSOL CONTAINER

[75] Inventors: Dieter Schrader, Duesseldorf; Karl Giede, Hilden; Hans Schneider, Schwalmtal; Dietholf Mehl, Duesseldorf, all of Fed. Rep. of Germany

[73] Assignee: Henkel Kommanditgesellschaft auf Aktien, Duesseldorf-Holthausen, Fed. Rep. of Germany

[21] Appl. No.: 861,038

[22] Filed: May 8, 1986

Related U.S. Application Data

[63] Continuation-in-part of Ser. No. 822,954, Jan. 27, 1986, abandoned, which is a continuation of Ser. No. 369,548, Apr. 19, 1982, abandoned, and a continuation-in-part of Ser. No. 623,680, Jun. 22, 1984, abandoned.

[30] Foreign Application Priority Data

Apr. 24, 1981 [DE] Fed. Rep. of Germany ..... 3116282
Jun. 27, 1983 [DE] Fed. Rep. of Germany ..... 3323070

[51] Int. Cl.[5] ..... B65D 83/14

[52] U.S. Cl. ..... 222/130; 141/20; 222/136

[58] Field of Search ..... 222/130, 131, 135, 136, 222/95, 105, 386.5, 389, 143, 94; 141/3, 20; 220/404, 3

[56] References Cited

U.S. PATENT DOCUMENTS

| | | | |
|---|---|---|---|
| 3,181,737 | 5/1965 | Chaucer | 222/136 |
| 3,343,718 | 9/1967 | Siegel et al. | 222/136 X |
| 3,451,593 | 6/1969 | Dillarstone | 222/130 |
| 3,698,453 | 10/1972 | Morane et al. | 222/136 X |
| 4,032,064 | 6/1977 | Giggard | 229/55 |
| 4,202,470 | 5/1980 | Fujji | 222/130 |
| 4,222,499 | 9/1980 | Lee et al. | 222/183 |
| 4,234,014 | 11/1980 | Knight | 220/3 X |
| 4,383,399 | 5/1983 | Stoody | 222/94 X |

FOREIGN PATENT DOCUMENTS

| | | | |
|---|---|---|---|
| 7119166 | 6/1972 | Fed. Rep. of Germany . | |
| 2123938 | 11/1972 | Fed. Rep. of Germany | 222/95 |

OTHER PUBLICATIONS

Seifen-Oele-Fette Wachse, vol. 108, No. 13/1982, 399/400.

*Primary Examiner*—F. J. Bartuska
*Attorney, Agent, or Firm*—Ernest G. Szoke; Wayne C. Jaeschke; Henry E. Millson, Jr.

[57] ABSTRACT

This invention is directed to an aerosol container system with two separate chambers, each of which contains a component to be mixed with the other component just prior to use. The container system comprises:

(a) a vertical arrangement of (i) a substantially unpressurized upper chamber for receiving a first component and (ii) a lower chamber for receiving a second component together with an amount of propellant sufficient for the expulsion of both components from the container system to said upper chamber being capable of receiving approximately the entire contents of the lower chamber upon activation;

(b) a connecting channel between the upper and lower chambers which comprises a mother-daughter valve assembly consisting of a bottom valve of the upper chamber as well as a top valve of the lower chamber, the valve assembly being positioned so that it is activated by mechanical movement of the upper and lower chambers against each other to permit the component and propellant in the lower chamber to be released into the upper chamber; and (c) a dispensing valve of the upper chamber, which is operated independently to dispense a mixture of the two components, as well as an improvement wherein the lower chamber has a nonadhering bag lining with an integral sealing ring.

11 Claims, 3 Drawing Sheets

DUAL CHAMBER AEROSOL CONTAINER

This application is a continuation-in-part of Ser. No. 822,954, filed Jan. 27, 1986, now abandoned, which in turn is a continuation of Ser. No. 369,548, filed Apr. 19, 1982, now abandoned, and a continuation-in-part of Ser. No. 623,680, filed June 22, 1984, now abandoned.

FIELD OF THE INVENTION

This invention is directed to an aerosol container having two separate chambers. More particularly, this invention is directed to an aerosol container having two chambers, wherein each chamber contains a component to be mixed with the other component and wherein the mixing takes place within the aerosol container by the simultaneous activation of one valve in each chamber.

BACKGROUND OF THE INVENTION

In a packaging system known from German published Gebauchsmuster No. 71 19 166, two pressurized containers or chambers are combined into a single unit, and these containers have valves which are operated simultaneously. The components contained in the respective containers are mixed together in a separate space or chamber upon the opening of the valves. Thus, the mixing process necessary before use takes place outside the chambers initially holding the components. Such an arrangement is also typical of other two-component packaging systems, such as the one described in German published patent application (DE-OS) No. 19 42 570. In each of these systems a separate mixing chamber is needed, and both chambers initially holding the components must be able to withstand the constant pressure of the propellants and any corrosion that may result from use of such propellants.

Another pressurized container assembly having two pressurized containers is described in U.S. Pat. No. 3,181,737 for dispensing liquids which are mixed together only when the liquids are to be discharged. More specifically, the patent provides a two-part dispenser comprising a first can or container having a first fluent material under atmospheric pressure, a second can or container having a second fluent material under pressure of a gas propellant, and means for coupling the cans together so that a valve of the second can is actuated to discharge the gas propellant and the second fluent material into the first can, the first can having a valve for discharging the mixture of fluents under pressure of the gas propellant.

Also, previously known is U.S. Pat. No. 3,451,593 which discloses a pressurized device for discharging a self-heating cosmetic preparation formed from two or more chemicals adapted to react exothermically and maintained in separate pressurized containers. The chemicals are stored in two separate containers, which each empty into a mixing chamber. There is no mixing of the total liquid contents of both containers in one of the containers. In fact, there is such a short time available for mixing that sufficient homogenization of the product to be dispensed cannot be assured.

U.S. Pat. No. 4,202,470 discloses a reusable two-chamber container assembly wherein one container propellant is contained in a sealed, flexible compartment positioned within the container as a mixture of gas and liquid under pressure in equilibrium at the temperature of the container.

All the internal protective lacquers and other chamber coatings which have hitherto been used have proved unstable to certain substances, for example hydrogen peroxide ($H_2O_2$), in the event of long-term storage. Accordingly, attempts have been made to prevent corrosion completely by a pressure pack system adapted to meet the requirements of aerosol packaging; i.e., by using a two-chamber pressure pack. Two-chamber or pressure pack systems of the type in question are described, for example, in "Aerosol Report", Vol. 20, No. 5/81, 170–175 and Vol. 21, No. 4/82, 172–182 and also in "Seifen-Oele-Fette-Wachse", Vol. 108, No. 13/1982, 399/400.

A two-chamber pressure pack or aerosol can of this type is disclosed in U.S. Pat. No. 4,032,064 which discloses a normal opening for the associated valve and an approximately 3 mm wide bottom opening designed to be closed by a rubber plug. The feature of this prior art two-chamber system which is of importance in the present connection is an inner bag of plastic which may be polyethylene, polypropylene, a metallic foil laminate, etc., and which, in the region of the valve opening, comprises an outwardly tucked edge which, after fitting, rests on the rolled edge of the can. The disclosed inner bag has preformed folding lines which provide for controlled folding and hence for complete emptying of the bag, on release of the product. In addition, the valve seat contains a butadiene rubber seal. Ideally, the inner bag is gripped between the seal and the rolled edge of the can after the valve has been clinched on.

This prior art inner bag fills only about two-thirds of the can volume and contains all the active substance. The remaining volume of the can is filled with propellant gas through the bottom opening, for example by means of an injector needle. The propellant gas does not come into contact with the active substance even during evacuation and, after emptying, is destroyed together with the can.

OBJECTS OF THE INVENTION

It is an object of the invention to provide a novel aerosol container.

It is also an object of this invention to provide a novel aerosol container for dispensing a mixture of two components which must be kept separate prior to use.

It is a further object of this invention to provide a dual chamber aerosol container system which can be produced at lower cost and which can be constructed in such a manner that only one chamber must be permanently compression-proof and resistant to propellants and unstable substances.

It is a yet further object of the invention to provide an aerosol container system with two separate chambers, each of which contains a component to be mixed with the other component just prior to use, which comprises:

(a) a vertical arrangement of (i) a substantially unpressurized upper chamber for receiving a first component and (ii) a lower chamber for receiving a second component together with an amount of propellant sufficiently adequate for the expulsion of both components from the container system, said upper chamber being capable of receiving approximately the entire contents of said lower chamber upon activation;

(b) a connecting channel between the upper and lower chambers, which channel comprises a mother-daughter valve assembly consisting of a bottom valve of the upper chamber as well as a top valve of the lower chamber, said valve assembly being positioned so that it is activated by mechanical movement of the upper and lower chambers against each other to permit the component and propellant in the lower chamber to be released into the upper chamber; and (c) a dispensing valve of the upper chamber, which is operated independently to dispense a mixture of the two components.

A still further object of the present invention is to develop a further improvement in the above aerosol container system in that, even under high pressure, it shows adequate storage stability with highly corrosive contents. In the aerosol pack comprising two vertically adjacent aerosol chambers connected by an adapter system, this is achieved by lining the lower chamber with an inner bag which is stable in storage with the chamber contents. The bag fills the chamber volume and a sealing ring adapted to the sealing profile of the valve is fitted onto the lower chamber. The sealing ring grips the edge of the bag and is integrally formed around it; i.e., around the periphery of the bag opening. The thickness of this sealing ring is several times greater than the wall thickness of the bag.

These and other objects of the invention will become more apparent in the discussion below.

DETAILED DESCRIPTION OF THE INVENTION

Figure 1:
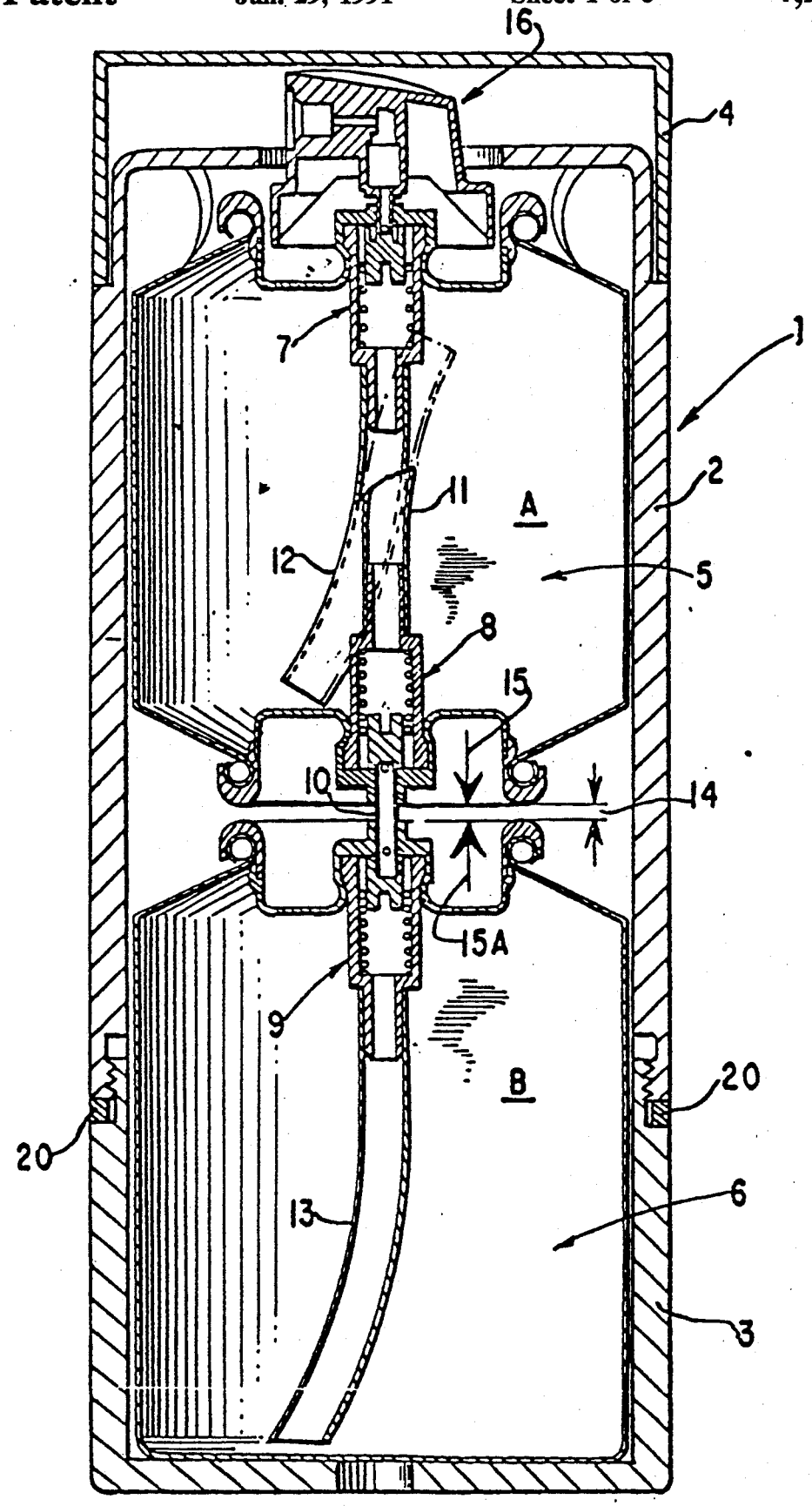
FIG. 1 is a cross-sectional view of one embodiment of the invention.

Applicants have developed an aerosol container system which complies with the objects expressed above. According to Applicants' invention, an aerosol container system is characterized by an integral container containing a vertical arrangement of (i) an upper chamber holding a first component substantially without pressure and (ii) a lower chamber holding a second component together with an amount of propellant generally adequate for the expulsion of the total component mixture, said upper chamber being capable of receiving approximately the entire contents of said lower chamber upon activation; a connecting channel between the chambers that can be opened, with the aid of a mother-daughter valve assembly consisting of a bottom valve of the upper chamber as well as a top valve of the lower chamber, which valve assembly is activated by mechanical movement of one chamber against the other; and a top or dispensing valve of the upper chamber which is operated independently.

More specifically, the invention is directed to an aerosol container system with two separate chambers, each of which contains a component to be mixed with the other component just prior to use, which comprises:

(a) a vertical arrangement of (i) a substantially unpressurized upper chamber for receiving a first component and (ii) a lower chamber for receiving a second component together with an amount of propellant sufficient for the expulsion of both components from the container system, said upper chamber being capable of receiving approximately the entire contents of said lower chamber upon activation, the volume of the upper chamber being in a from about 5 to 50 percent excess based upon the volume of a mixture of the components in the upper and the lower chambers;

(b) a connecting channel between the upper and lower chambers which channel comprises a mother-daughter valve assembly consisting of a bottom valve of the upper chamber as well as a top valve of the lower chamber, said valve assembly being positioned so that it is activated by mechanical movement of the upper and lower chambers against each other to permit the component and propellant in the lower chamber to be released into the upper chamber, the bottom valve in the upper chamber being a back pressure valve and being connected to a riser which ends in the upper part of the upper chamber, and the stem of the bottom valve of the upper chamber being centered over the top valve of the lower chamber;

(c) a dispensing valve of the upper chamber which is operated independently to dispense a mixture of the two components; and (d) an outer covering encompassing the upper and lower chambers, said outer covering being constructed so as to permit mechanical movement of the upper and lower chambers against one another, wherein the dispensing valve of the upper chamber is connected to a riser which reaches substantially to the bottom of the upper chamber or the top valve of the lower chamber is connected to a riser which reaches substantially to the bottom of the lower chamber, or both.

Additionally, the invention comprises using the inner bag known from the single chamber pressure pack in a two-chamber pressure pack and making this transfer possible by providing the inner bag itself with an integrally formed sealing ring which, at the same time, makes the additional use of a rubber seal superfluous. From the processing point of view, an inner bag designed in this way has the advantage that it can be placed flat and securely onto the edge of the can/chamber and can be pressed into the associated sealing groove when the valve cover is fitted.

Preferably, the axial thickness and radial width of the sealing ring are considerably greater than the wall thickness of the bag. The sealing ring may have a diameter of about 1 mm and a width of about 3 mm, although these dimensions are not critical. The bag itself should consist of a material which is stable when stored with the active substance to be accommodated, even in the event of prolonged storage under high pressure. Suitable plastic bag materials for storing dilute hydrogen peroxide solutions are elastomers of polychloroprene, polybutadiene, chlorobutyl, ethyl/propyl terpolymer, fluorine/chlorine elastomer, polypropylene and polyethylene, their mixtures, and the like. Polyethylene is preferred.

The invention therefore is also directed to an aerosol container system with two separate chambers each of which contains a component to be mixed with the other component just prior to use, which comprises:

(a) a container;

(b) an upper chamber and a lower chamber housed in spaced relationship within said container;

(c) an opening in said upper chamber at its top with a first head valve assembly sealingly seated therein and an opening at its bottom with a bottom valve assembly sealingly seated therein;

(d) an opening in said lower chamber at its top surrounded by a collar and a second head valve assembly positioned in said opening;

(e) conduit means flowingly connecting said bottom valve assembly and said second head valve assembly, permitting these valves to operate synchronously when the two chambers are moved toward each other;

(f) a collar which is an integrally formed rolled edge of the top opening in said lower chamber;

(g) positioning said second head valve assembly a spaced distance within said collar; and affording (h) a flexible bag nonadheringly lining the inside of said lower container and having an opening at its top; said flexible bag being of material resistant to hydrogen peroxide solution; and (i) a sealing ring integrally formed from the bag material and located around the periphery of said bag opening, said sealing ring being several times thicker than the wall thickness of said bag and sealingly positioned within the space between said collar and said second head valve assembly.

Because the upper chamber itself is used according to the invention as a mixing compartment for the components, the storing of the entire propellant together with the second component in the lower chamber is possible prior to use. The second component is then propelled with the aid of the propellant into the upper chamber—until the pressure in both chambers equalizes—and then, due to the still adequate excess pressure of the propellant, the mixture of the components in the upper chamber is available for its intended purpose upon activation of the top or dispensing valve of the upper chamber. Consequently, according to the invention, the upper chamber, provided with two openings, can be produced of plastic, such a polypropylene, polyethylene, or polyacrylate polymers or copolymers. This plastic chamber may simultaneously encompass the second chamber, fashioned preferably of aluminum or another material as a monoblock can, within its lower extension, by means of a suitable configuration. However, both chambers can also basically be conventional aerosol containers of any desired material composition, for example, glass, metal, or plastic. The chambers can also be of aluminum or another material as a monoblock can which contains a protective layer of plastic, paint, etc., which is resistant to the action of the active contents of the chamber, such as hydrogen peroxide solution.

Also, the upper and lower chambers are encompassed by an outer covering, preferably of rigid material but being constructed so as to permit the chambers to move against one another. For example, the covering could comprise two parts connected by slidable or flexibly joint.

The container system according to the invention can be used for all products having two components which must be stored separately before use. Such products include, for example, products that change the color of the hair consisting of two components to be stored separately, such as color rinses, bleaches, or dyes, as well as cosmetics and also glues, particularly two-component glues, two-component foam systems, and two-component floor care products. In principle, these are instances in which the completely mixed product cannot be stored for later use because of chemical or physical reasons. Thus, the container system of the invention is intended for a single application or for repeated applications made at very brief time intervals.

The container system according to the invention is relatively universally applicable as far as the volume of the components to be stored are concerned. The invention is not intended to be limited to particular dimensions of, for example, the chambers, and it is within the scope of the invention that the dimensions of the chambers, valves, and the like would be adaptable by an art-skilled person to the particular components and applications being considered. The only aspect to be kept in mind for the construction of the container system of the invention is the adequacy of the amount of propellant stored in the lower chamber for the largely complete expulsion of the entire volume of product. In addition to this, sufficient shaking space for the mixture should be provided in the upper chamber in most cases. Such additional shaking space in the upper chamber advantageously amounts to from about 5 to 50 percent of the volume of the total mixture consisting of the two components.

It is within the scope of the invention that for a given product, each of the two components could be filled into either one of the two chambers. Thus, for example, one component could be in the lower chamber and the other component could then be in the upper chamber, or vice versa.

Since the inner bag, when present, in the two-chamber system is pressureless and does not perform an external sealing function, it does not have to meet any particular sealing requirements. If an inner bag such as this were to be used for lining the lower chamber, it would have to fill the entire lower chamber and, in addition to the active substance of the lower chamber, would also have to accommodate the propellant gas. However, if the prior art inner bag were permanently subjected to high pressure, the hitherto standard sealing of the edge of the bag to the rolled edge of the can would frequently fail in storage test. This is because, when the valve is installed, the edge of the bag lying on the rolled edge of the can would be pushed at least partly into the lower chamber. In addition, the edge of the bag can slip away from the sealing zone during the clinching operation and, in the extreme case, can be drawn at least partly into the can by the spreading movement of the clinching tool. This produces leakage zones in the region of the valve which can not be tolerated where the inner bag is under the high internal pressure of a propellant gas.

DETAILED DESCRIPTION OF THE INVENTION

The invention can be better understood by making reference to the drawing. In the FIG. 1, container 1 consists of an upper casing 2 and a lower casing 3 joined together at joint 20, and an upper chamber 5 and a lower chamber 6 are inserted into container 1. Cap 4 is removably attached to the upper surface of container 1. Upper chamber 5 has a top valve 7 and a bottom valve 8. The top valve 7 can be a conventional aerosol disc valve, but it can also be fully integrated with a plastic chamber. The bottom valve 8 of upper chamber 5 is, in principle, in the form of a conventional disc valve. However, it can also be in the form of a back pressure valve, which, due to its construction, prevents backflow of the contents of the upper chamber 5 into lower chamber 6. The lower chamber 6, usually in the form of a conventional aerosol can, has a top valve 9, which, together with the bottom valve 8 for upper chamber 5, acts like a mother-daughter valve assembly of conventional construction.

The two product chambers 5 and 6 are arranged one above the other so that the stem of bottom valve 8 of upper chamber 5 is centered over top valve 9 of lower chamber 6. Upper chamber 5 can be pressed against lower chamber 6 (or vice versa) by a mechanical moving of chambers 5 and 6 against each other, for example, by pressing on an external hoop or with the aid of a bayonet system, but also by screwing or indentations. The mother-daughter valve assembly 8, 9, and thus the connecting channel 10 between chambers 5 and 6, is opened by this relative movement.

Prior to use of the system, upper chamber 5 contains a first product, Product A, in an unpressurized state, that is, internal pressure is substantially equal to atmospheric pressure, and lower chamber 6 contains a second product, Product B, together with a propellant. When the mother-daughter, or daughter-mother, valve assembly system is activated, the stem of bottom valve 8 of upper chamber 5 opens top valve 9 of lower chamber 6, propelling Product B into the preferably unpressurized upper chamber 5 with the aid of the propellant. During this operation, the propellant also moves from the lower to the upper chamber until the pressure in each chamber has equalized. This action takes place only in one direction, which means that the products mixed in upper chamber 5 do not flow back into lower chamber 6 because of the residual pressure present in lower chamber 6. Dependent upon the type of components used, however, a back pressure valve can be installed in connecting channel 10 of chambers 5 and 6—for example, instead of bottom valve 8 or top valve 9—as an additional safeguard against backflow of the contents of upper chamber 5 into lower chamber 6.

Upper product chamber 5 can be equipped with one or two risers or tubes 11 and 12. Riser 11 can start from bottom valve 8 and end in the upper part of upper chamber 5, in the product or the mixture. This arrangement can produce or facilitate a foaming or a mixing, as the system is activated. Top valve 7 of upper chamber 5 can also be equipped with a riser 12, which reaches close to the bottom of the chamber. A similar riser 13 can be provided, starting from top valve 9 of lower chamber 6 and reaching to its bottom. This riser guarantees that, with the system in vertical position, almost the entire volume of product in the lower chamber can be brought into the upper chamber.

For the operation of the two-component aerosol container according to the invention, the two chambers 5 and 6 are first pressed against each other in the direction of two arrows 15 and 15A, approximately the coupling distance 14. A pressure may be exerted, for example, directly on upper chamber 5 for this purpose. Connecting channel 10 between the chambers is opened when chambers 5 and 6 are pressed together so that Component B contained in lower chamber 6 flows into upper chamber 5, together with propellant, until the pressure in each of chambers 5 and 6 equalizes. If necessary, the mixture in upper chamber 5 can be homogenized by shaking. The final mixture can then be used for the intended purpose through the spray head or applicator 16, by activating or opening top valve or dispensing valve 7 of upper chamber 5. Naturally cap 4 must be removed from container 1 before use.

Since upper chamber 5 is pressurized only during the short time of the actual application of the system according to the invention, respective safety measures against a leak or decomposition of the contents or damage of the walls of this chamber are not required. It is sufficient that chamber 5 be constructed in such a manner that it will withstand the relatively brief pressure increase due to the propellant entering from lower chamber 6.

Figure 2:
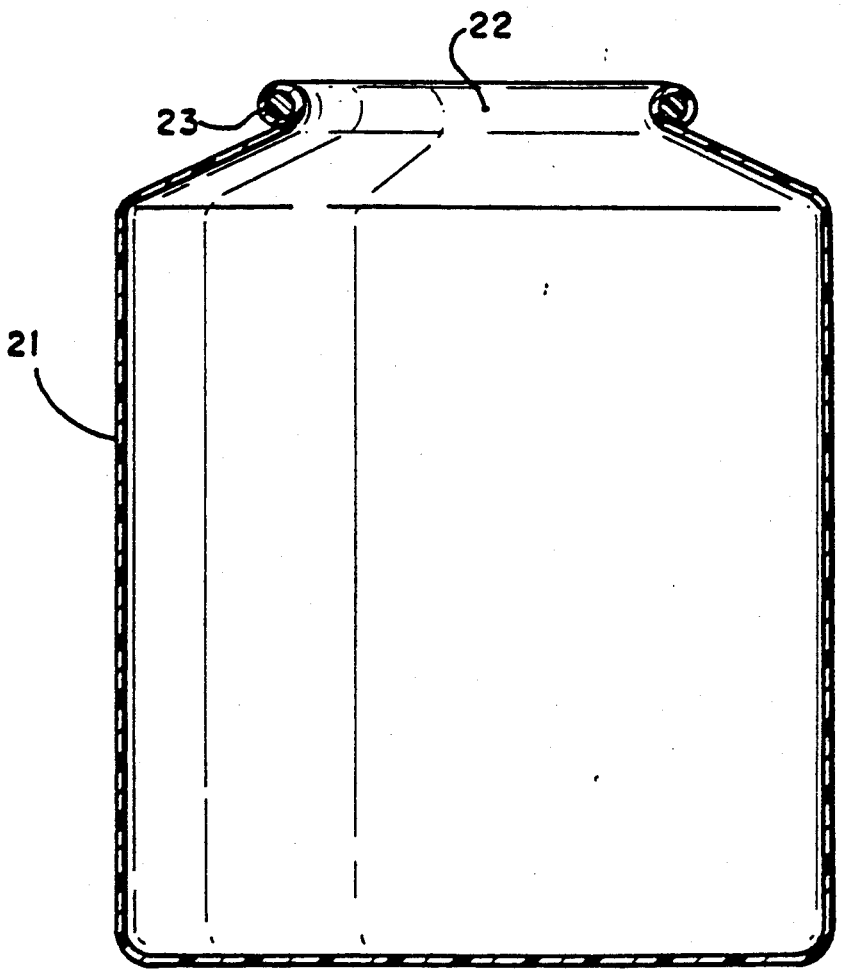
FIG. 2 is a cross-sectional view of a plastic bag adapted to contain corrosive or otherwise unstable substances.

FIG. 2 shows the inner bag 21 of which the crucial feature is the sealing ring 23 integrally formed around the edge of the bag opening 22. This sealing ring 23 replaces the outwardly tucked edge encountered in the two-chamber system. For application, the inner bag 21 is introduced into the lower chamber of the aerosol pack which is designed to accommodate the propellant gas and some of the active substance. An example of one such embodiment is diagrammatically illustrated in FIG. 3.

Figure 3:
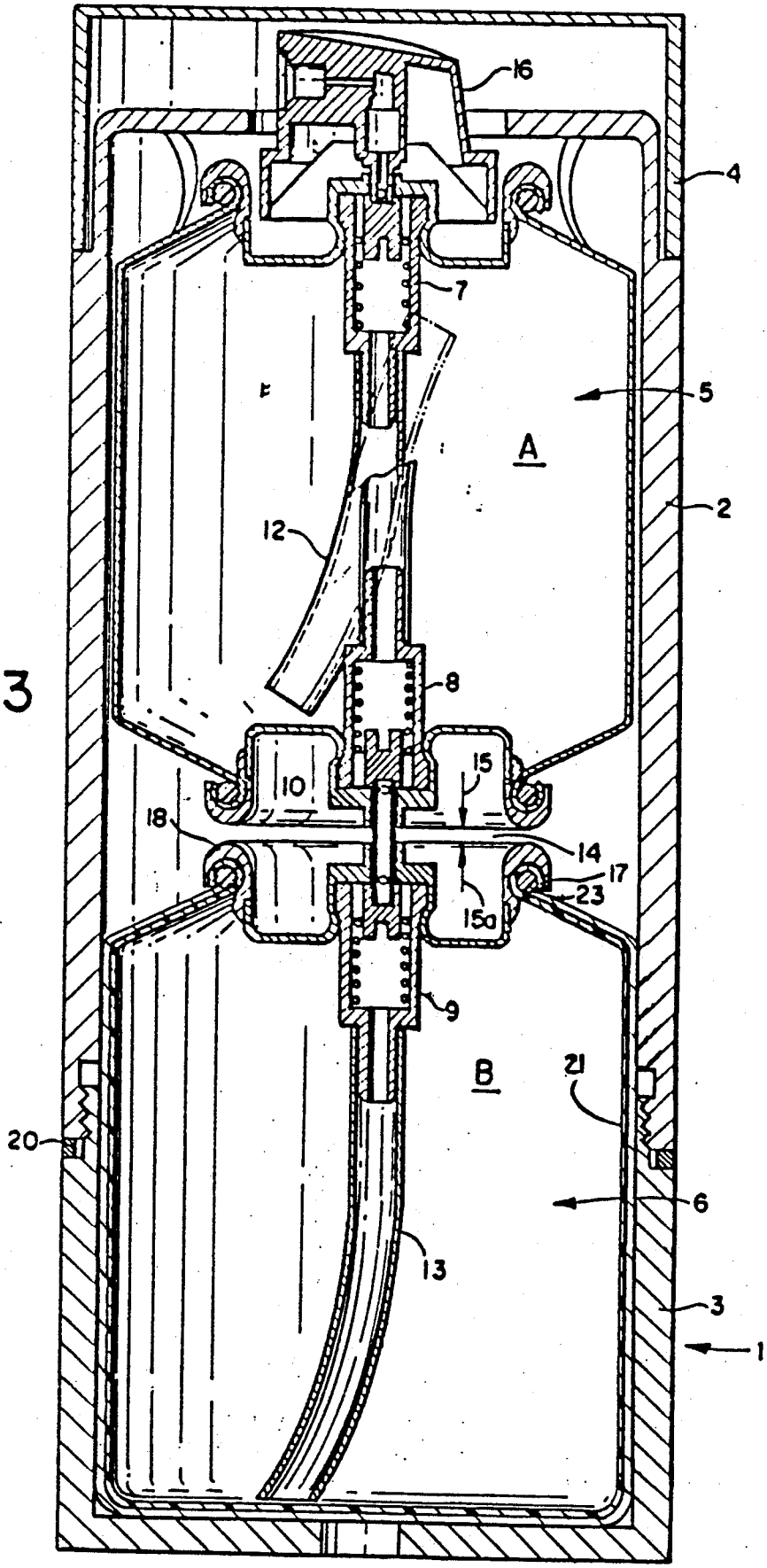
FIG. 3 is a cross-sectional view of another embodiment of the invention including the plastic bag liner.

The aerosol device shown in FIG. 3 comprises a container generally denoted by the reference 1 and having an upper casing 2 and a lower casing 3. An upper chamber 5 and a lower chamber 6 are inserted into the container which also has a removable cap 4. The upper chamber 6 has a first head valve 7 and a bottom valve 8. The lower chamber 6, which in general is in the form of a conventional aerosol can, comprises a second head valve 9 which works synchronously with the bottom valve 8 of the upper chamber 5 like a conventional mother-daughter valve.

Of crucial importance in the present invention are the lining of the lower chamber 6 with the inner bag 21 and the wedging of the sealing ring 23 (which is integrally formed around the edge of the bag) between the rolled can edge 17 of the lower chamber 6 and the sealing groove 18 belonging to the head valve 9 of the lower chamber 6.

It should be noted that the rolled edge 17 of the lower chamber top opening can more broadly be described as a collar. The purpose of this collar is to afford a surface which surrounds the valve gasket of the second head valve assembly 9 at a spaced distance, which space accommodates the sealing ring in a sealing (gas-tight) relationship. The rolled edge 17 is preferred because it is more economical to employ and avoids fitting an additional part on the lower chamber (can) 6.

The valve assemblies all comprise not only the valves themselves, but also a surrounding valve gasket which preferably has an external flange that permits tight sealing of the valve assemblies in the upper chamber top opening and bottom opening. The same flange on the lower chamber second head valve assembly 9 provides the opposing surface to the collar or rolled edge for biasing against the sealing ring 23 to afford the required tight fit.

The two product chambers 5 and 6 are preferably arranged one above the other in such a way that the stem of the bottom valve 8 of the upper chamber 5 is situated centrally over the head valve 9 of the lower chamber 6. By mechanically displacing the chambers 5 and 6 toward one another, for example by applying pressure to an external clip or by means of a bayonet system or even a screwthread or interengaging teeth, the upper chamber 5 can be pressed against the lower chamber 6 (or vice versa). The resulting relative movement opens the mother-daughter valve assembly 8, 9 and, hence, the connecting passage 10 between the chambers 5 and 6.

The upper product chamber 5 may be equipped with one or two risers 11 and 12, one of which 11—starting from the bottom valve 8—may terminate in the upper part of the upper chamber 5 within the product or mixture. In this way, it is possible to obtain or at least facilitate foaming or mixing of the product when the system is actuated. The head valve 7 of the upper chamber 5 may also be equipped with a riser 12 extending into the vicinity of the base of the chamber. A similar riser 13 may be provided, starting from the head valve 9 of the lower chamber 6 and extending to the base thereof. This riser ensures that, when the system is in the vertical position, virtually the entire product volume of the lower chamber 6 can be brought into the upper chamber.

To actuate the two-component aerosol device, the two chambers 5 and 6 are first pressed toward one another in the direction of the arrows 15, 15A by approximately the coupling distance 14 indicated in the drawing of FIG. 3. To accomplish this, one may apply pressure directly to the upper chamber 5 which results in pressure directed against the lower chamber 6. This pressing together of the chambers 5 and 6 opens the connecting passage 10 between the chambers so that component B contained in the lower chamber 6 flows together with propellant gas into the upper chamber 5 until pressure equalization is obtained. The mixture of component A of the upper chamber 5 and component B of the lower chamber 6 may then be homogenized by shaking. The prepared mixture may be put to its intended use by actuating or opening the first head valve 7 of the upper chamber 5 to release the mixture through a spray head or applicator 16.

The following example is intended to illustrate the invention and should not be construed as limiting it thereto.

EXAMPLE

Thirty grams of an ammoniacal dye solution containing an oxidation dye are filled into a monoblock can of aluminum with a capacity of 75 ml, and the can is sealed. An additional monoblock can of aluminum with a capacity of 50 ml is filled with 35 gm of a stabilized $H_2O_2$-solution (3.6 of 9%) and is pressurized to a maximum of 8 bar with propellant. The $H_2O_2$ solution is released into the alkaline reaction solution with a mother-daughter valve adapter system, and mixed well. The reaction mixture with a pH of less than 9 can now be applied as color rinse or dye through a foam valve, the top valve 7 of upper chamber 5.

It was surprising to note that no rise in pressure due to possibly released oxygen occurred, despite the somewhat high proportion of $H_2O_2$ in the alkaline medium. On the contrary, the chamber pressure remained stable for several days.

Bleaching, for which a 12% $H_2O_2$-solution is needed, can also be carried out with this system. Other two-component products with $H_2O_2$ as a reaction partner can also be formulated.

Preferably, however, it is advisable to employ a coated or lined lower chamber 6 or even a plastic chamber. As is well known $H_2O_2$ solutions are destabilized in the presence of metal causing release of oxygen. The best results are obtained with the use of the plastic bag liner of the lower chamber.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An aerosol container system with two separate chambers, each of which contains a component to be mixed with the other component just prior to use, which consists essentially of:

(a) a vertical arrangement of (i) a substantially unpressurized upper chamber for receiving a first component and (ii) a lower chamber for receiving a second component together with an amount of propellant sufficient for the expulsion of both components from the container system, said upper chamber being capable of receiving approximately the entire contents of said lower chamber upon activation, the volume of said upper chamber being in a from about 5 to 50 percent excess based upon the volume of a mixture of the components in said upper chamber and said lower chamber, said upper chamber and said lower chamber being spaced a coupling distance from each other;

(b) a connecting channel between said upper chamber and said lower chamber which channel comprises a mother-daughter valve assembly consisting of a bottom valve of said upper chamber as well as a top valve of said lower chamber, said valve assembly being positioned so that it is activated by mechanical movement of said upper chamber and said lower chamber against each other to permit the component and propellant in said lower chamber to be released into said upper chamber, the bottom valve in said upper chamber being connected to a riser which ends in the upper part of said upper chamber, and the stem of the bottom valve of said upper chamber being centered over the top valve of said lower chamber;

(c) a dispensing valve of said upper chamber which is operated independently to dispense a mixture of the two components;

(d) an outer covering encompassing said upper chamber and said lower chamber, said outer covering being constructed so as to permit mechanical movement of said upper chamber and said lower chamber against one another, wherein said dispensing valve of said upper chamber is connected to a riser which reaches substantially to the bottom of said upper chamber;

(e) an opening in said upper chamber at its top to sealingly seat said dispensing valve, and an opening in said upper chamber at its bottom to sealingly seat said bottom valve of said upper chamber;

(f) an opening in said lower chamber at its top to sealingly seat said top valve of said lower chamber, said opening being surrounded by a collar comprising an integrally formed rolled top edge of said lower chamber;

(g) a flexible bag nonadheringly lining the inside of said lower chamber and having an opening at its top, said flexible bag being made of a material resistant to hydrogen peroxide solution; and (h) a sealing ring integrally formed from the bag material and located around the periphery of said bag opening, said sealing ring being several times thicker than the wall thickness of said bag and sealingly positioned within the space between said collar and said top valve of said lower chamber.

2. The aerosol container system of claim 1 wherein each of said upper chamber and said lower chamber are inert to destabilization of aqueous $H_2O_2$ solutions.

3. The aerosol container system of claim 1 wherein the bottom valve in said upper chamber is a back pressure valve.

4. The aerosol container system of claim 1 wherein said top valve of said lower chamber is connected to a riser which reaches substantially to the bottom of said lower chamber.

5. An aerosol container system with two separate chambers, each of which contains a component to be mixed with the outer component just prior to use, which consists essentially of:

(a) a vertical arrangement of (i) a substantially unpressurized upper chamber for receiving a first component and (ii) a lower chamber for receiving a second component together with an amount of propellant sufficient for the expulsion of both components from the container system, said upper chamber being capable of receiving approximately the entire contents of said lower chamber upon activation, the volume of said upper chamber being in a from about 5 to 50 percent excess based upon the volume of a mixture of the components in said upper chamber and said lower chamber, said upper chamber and said lower chamber being spaced a coupling distance from each other;

(b) a connecting channel between said upper chamber and said lower chamber which channel comprises a mother-daughter valve assembly consisting of a bottom valve of said upper chamber as well as a top valve of said lower chamber, said valve assembly being positioned so that it is activated by mechanical movement of said upper chamber and said lower chamber against each other to permit the component and propellant in said lower chamber to be released into said upper chamber, the bottom valve in said upper chamber being a back pressure valve and being connected to a riser which ends in the upper part of said upper chamber, and the stem of the bottom valve of said upper chamber being centered over the top valve of said lower chamber; and (c) a dispensing valve of said upper chamber, which is operated independently to dispense a mixture of the two components, wherein said upper chamber consists of plastic and is formed to extend over said lower chamber.

6. An aerosol container system with two separate chambers each of which contains a component to be mixed with the other component just prior to use, which consists essentially of:

(a) a container;

(b) an upper chamber and a lower chamber housed in spaced relationship a coupling distance from each other within said container;

(c) an opening in said upper chamber at its top with a first head valve assembly sealingly seated therein, and an opening at its bottom with a bottom valve assembly sealingly seated therein;

(d) an opening in said lower chamber at its top surrounded by a collar which is an integrally formed rolled edge of the top opening in said lower chamber, and a top valve assembly positioned in said opening;

(e) conduit means flowingly connecting said bottom valve assembly and said top valve assembly, permitting these valves to operate synchronously when said upper chamber and said lower chamber are moved toward each other;

(f) flexible bag nonadheringly lining the inside of said lower chamber and having an opening at its top; said flexible bag being of material resistant to hydrogen peroxide solution; and (g) a sealing ring integrally formed from the bag material and located around the periphery of said bag opening, said sealing ring being several times thicker than the wall thickness of said bag and sealingly positioned within the space between said collar and said top valve assembly.

7. The aerosol container system of claim 6 wherein said bag and integral sealing ring are formed from elastomers of the group consisting of polychloroprene, polybutadiene, chlorobutyl, ethyl/proply terpolymer, fluorine/chlorine elastomer, polypropylene, polyethylene, or any mixture thereof.

8. The aerosol container system of claim 6 wherein said bag and integral sealing ring material is polyethylene.

9. The aerosol container system of claim 6 wherein said sealing ring is more than two times thicker than the wall thickness of said bag.

10. The aerosol container system of claim 7 wherein said sealing ring is more than two times thicker than the wall thickness of said bag.

11. The aerosol container system of claim 8 wherein said sealing ring is more than two times thicker than the wall thickness of said bag.

* * * * *